US006298491B1

(12) United States Patent
Blustin et al.

(10) Patent No.: US 6,298,491 B1
(45) Date of Patent: Oct. 9, 2001

(54) DISPOSABLE GLOVES

(75) Inventors: Leslie Miles Blustin, Radlett; Gregory James Murray, Cuffley, both of (GB)

(73) Assignee: B. M. Polyco Limited, Enfield (GB)

( * ) Notice: Subject to any disclaimer, the term of this patent is extended or adjusted under 35 U.S.C. 154(b) by 0 days.

(21) Appl. No.: 09/743,176

(22) PCT Filed: Jul. 7, 1999

(86) PCT No.: PCT/GB99/02192

§ 371 Date: Mar. 19, 2001

§ 102(e) Date: Mar. 19, 2001

(87) PCT Pub. No.: WO00/01262

PCT Pub. Date: Jan. 13, 2000

(30) Foreign Application Priority Data

Jul. 7, 1998 (GB) ..... 9814743

(51) Int. Cl.[7] ..... A41D 19/00
(52) U.S. Cl. ..... 2/163; 2/46; 2/161.6; 2/167
(58) Field of Search ..... 2/163, 159, 161.6, 2/161.7, 167, 46

(56) References Cited

U.S. PATENT DOCUMENTS 2,054,559 * 9/1936 Dunn .
2,810,131 10/1957 Kogut .
3,683,420 * 8/1972 Vilain .
3,866,245 2/1975 Sutherland .
4,109,042 * 8/1978 Estes et al. .
4,845,781 * 7/1989 Strickland et al. .
4,916,757 * 4/1990 Berlin et al. .
4,924,530 * 5/1990 Tagaya .
4,928,322 * 5/1990 Bradfield .
5,016,286 * 5/1991 Henriksen .
5,020,160 * 6/1991 Cano .
5,025,503 * 6/1991 O'Brien .
5,138,718 * 8/1992 Willard .
5,210,880 * 5/1993 Yale .
5,806,099 * 9/1998 Grinberg .

FOREIGN PATENT DOCUMENTS 10072712 3/1998 (JP) .
WO 94/16586 8/1994 (WO) .

OTHER PUBLICATIONS

Guggenheim, "Gloves for Handling Corrosive Materials", IBM Technical Disclosure Bullet, vol. 8, No. 4, Sep. 1965, p. 622.

* cited by examiner

*Primary Examiner*—Rodney M. Lindsey
(74) *Attorney, Agent, or Firm*—Lawrence E. Laubscher, Jr.

(57) ABSTRACT

The present invention concerns a disposable glove 1 comprising first and second juxtaposed shaped film of heat resistant plastics material, said films being sealed together around their peripheries 2 except in the vicinity of an opening 3 dimensioned and located to accommodate insertion and withdrawal of a hand. The heat resistant plastics material may be a polyamide. The glove is shaped so as to facilitate donning and removal, the finger compartments, e.g. 4, 5 accommodating only an upper part of each finger.

11 Claims, 2 Drawing Sheets

DISPOSABLE GLOVES

This invention relates to disposable gloves, a term intended herein (for the avoidance of doubt) to embrace also gauntlets, and it relates especially to gloves intended to protect material being handled, such as food, from contaminants associated with a handle, or vice versa.

In the catering industry, for example, there is a need for disposable gloves that enable operatives to handle foodstuffs without the risk of transferring to the foodstuffs contaminants from the hands. The gloves must therefore be impermeable to the contaminants anticipated yet cheap and moreover, especially where it is necessary for a handler to transfer hot foodstuffs, such as burgers, from a cooking area to a serving or food preparation area, it is important that the gloves can tolerate at least brief contact with cooking utensils and/or the hot food itself without degradation, and particularly without adherence to the appliance and/or the food.

Difficulties arise in providing gloves having the above-desired attributes, and further difficulties are associated with the retention of mobility and dexterity of the wearer's fingers and hands, the accommodation of under-gloves which may, for example, have heat-resistant capabilities, and the ready donning and/or removal of the gloves.

In non-catering industries, a principal requirement may be to protect an operative's hands from contaminants in materials that are being handled, but the above recited difficulties (mutatis mutandis) still arise.

In this connection, there are currently available gloves formed of polyethylene which are used in the catering industry. Such known gloves take the form shown in FIG. 1 in the drawings. A significant problem associated with such gloves is that they have a low tolerance to heat, i.e. a low melting point. Hence when used with hot foods and hot utensils, such known gloves have been known to melt which has obvious food hygiene problems and can cause severe burns to the hands where the glove melts onto the skin of the wearer. The problem of burning the hands of the wearer is exacerbated due to the shape of known gloves which inhibits quick donning and removal.

It is known from U.S. Pat. No. 3,886,245 that hand-shaped plastic gloves with heat-sealed seams can be fabricated in a die-stamping process. However, the gloves so produced are said to exhibit the disadvantage of sticking to a wearer's hands due to perspiration, and the specification is concerned with the incorporation of suitable liners to prevent this happening. Other solutions, such as dusting or the fabrication of oversized gloves, are dismissed as unsatisfactory.

Another approach is advocated in IBM Technical Disclosure Bulletin, vol.8, no.4, September 1965 (1965-09), page 622 XP-002119958 wherein a plastics material is made by vacuum-forming into the shape of a wearer's fingers and palm, and the resulting glove-like shape is heat-sealed onto a flat film backing layer. This approach is said to provide gloves with improved flexibility of motion and to prevent tearing due to friction.

Both of the above-mentioned disclosures, however, relate to gloves which are fabricated so as to resemble, and thus closely fit to, a wearer's hand and thus do not meet the requirements of the present invention, or overcome the difficulties it seeks to address.

It is thus an object of the invention to provide disposable gloves directed to meeting at least one of the foregoing requirements whilst seeking to overcome at least one of the above-mentioned difficulties.

According to the present invention there is provided a disposable glove comprising first and second juxtaposed shaped films of plastics material, said films being sealed together around their peripheries except in a region thereof forming an opening dimensioned and located to accommodate insertion and withdrawal of a user's hand; characterised in that the glove comprises respective compartments, each positioned and dimensioned to accommodate only part of the length of a respective finger of the user, the plastics material forming webs between adjacent fingers.

This permits of greater mobility and dexterity as compared with mitten like gloves in which all fingers share a common compartment.

In preferred embodiments, the plastics material has a melting point in the vicinity of 200 degrees C. or greater.

Preferably also, the breadth dimension of each finger compartment is substantially larger than necessary to accommodate a finger. This facilitates donning and removal of the gloves end/or assists in accommodating undergloves.

Preferably, the length dimension of each finger compartment, being shorter than that necessary to accommodate the whole finger, extends to the vicinity only of the second finger joint (reference to the fingertip). This further assists in rapid donning and removal, provides the wearer with an ability to readily bend each finger both at the said second joint and at the knuckle joint; and moreover provides a "web" extending between adjacent fingers which aids in handling certain products or materials.

It is particularly preferred that, notwithstanding the aforementioned relationship between the length of each finger compartment and the respective finger which that compartment is intended to accommodate, the thumb compartment of the glove is dimensioned to accommodate substantially the entire length of the wearer's thumb.

Preferably also the glove, when measured across the palm area and the wrist aperture, is substantially wider than necessary to accommodate the wearer's hand and wrist. This further aids in rapid donning and removal.

In a second aspect of the present invention there is provided a glove comprising a generally sealed pouch for accommodating a hand, the pouch having respective compartments defined therein, said compartments being positioned and dimensioned to accommodate only an upper part of each finger.

Preferably, the plastics material (not woven) is a polyamide material, such a nylon film, for example Nylon 6 or Nylon 66, or another material whose melting point is in the vicinity of 200 degrees C. or greater. The material is in preferred embodiments non porous.

Nylon has the particular advantage that in addition is offering heat resistance, it is relatively chemically inert and is thus strongly resistant to chemical attack.

In order that the invention may be clearly understood and readily carried into effect, one embodiment thereof will now be described, by way of example only, with reference to the accompanying drawings, in which.

Figure 1:
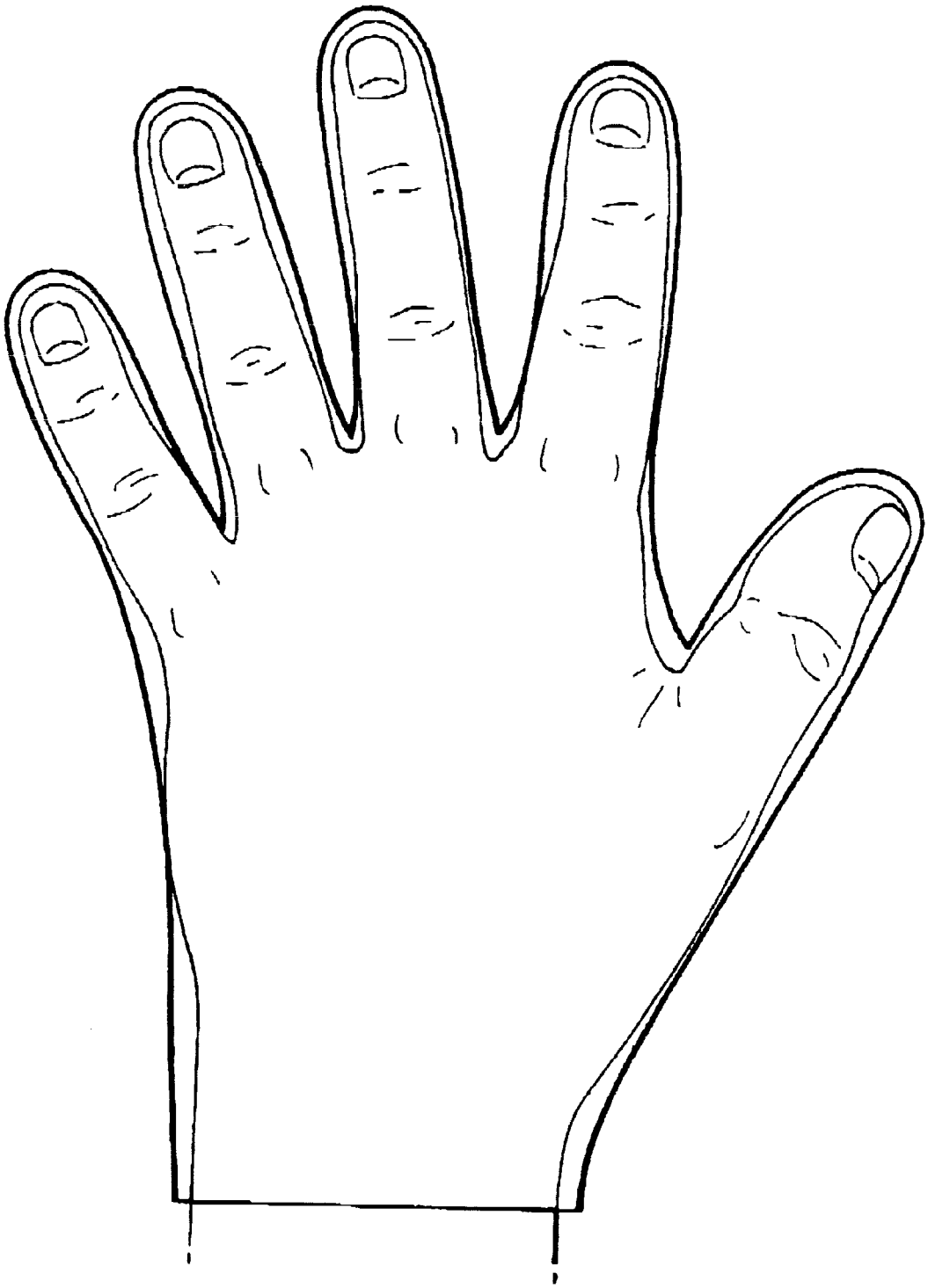
FIG. 1 Prior Art.
FIG. 1 shows in plan view a prior art glove.
Figure 2:
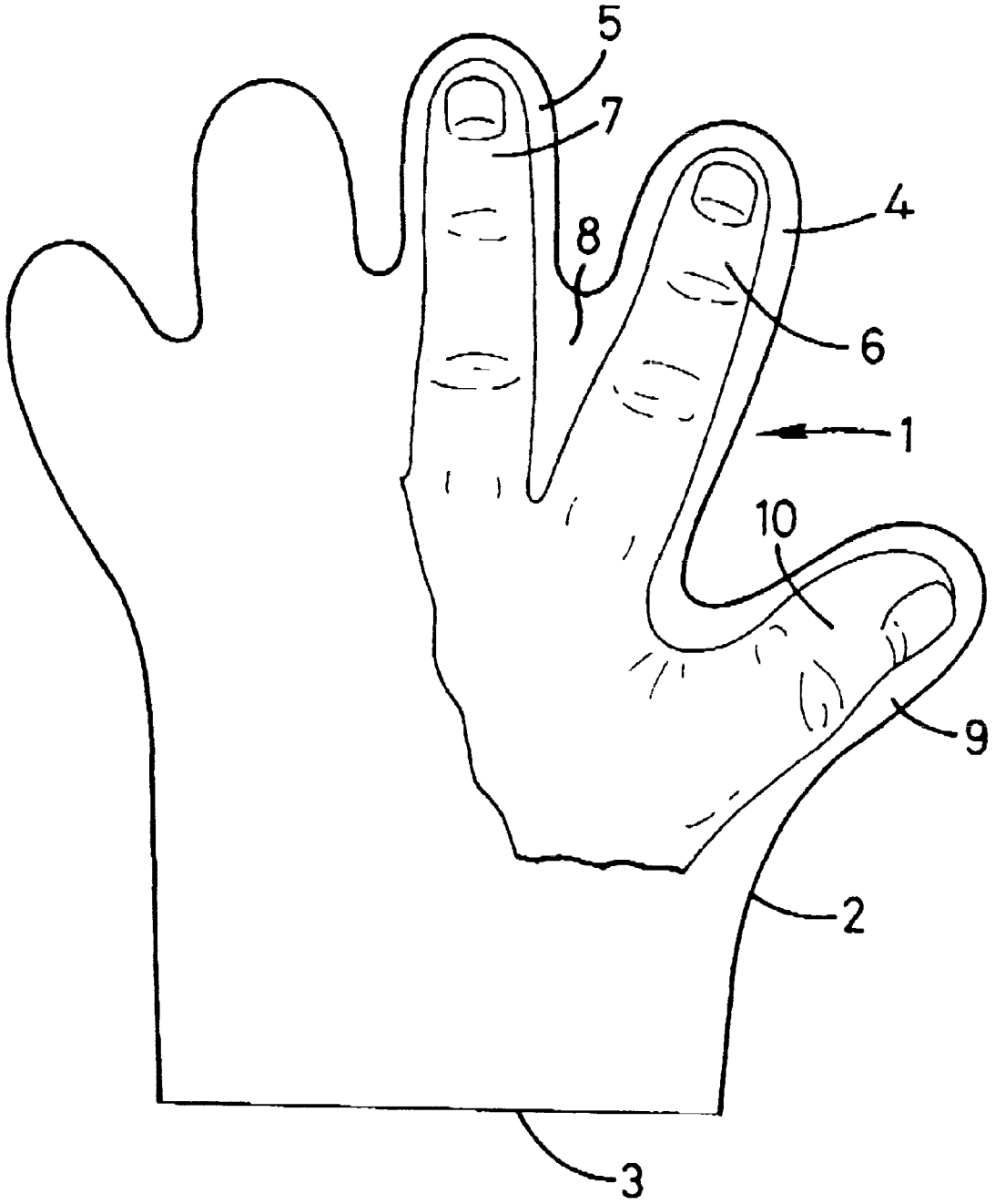
FIG. 2 shows, in plan view, a glove in accordance with one example of the invention, together with an outline of part of a typical hand which the glove is dimensioned to accommodate.

Referring now to FIG. 2 of the drawings, a glove 1 is constructed by sealing together, as by heat sealing, two juxtaposed, shaped films of polyamide film material, e.g. nylon, around their peripheries, as at 2, apart from an aperture at 3 intended to permit application and removal of the glove and generally lying, when worn, in the wrist area of the wearer. In the case of a gauntlet (not shown) the aperture 3 would of course lie further up the wearer's arm.

The nylon film, e.g. Nylon 6 or Nylon 66 (not in woven form) once produced in its virgin form, is stored in warm conditions to keep the material malleable. Prior to conversion of the virgin film into the required, generally "hand-like" shape, the film is conditioned in a warm, humid environment, or locally by means of a steam bath. The film is then run on a film sealing machine, in which it moves along a conveyor belt which advances it under a die moulded to the appropriate "hand-like" shape. The die is pressed downwards on to the film, and heated to a temperature above the melting point of the nylon 6 film (about 200 degrees C.) thus causing the film to melt and sealing it to the shape of the die.

As can be seen, the finger compartments such as 4 and 5 are wider and shorter than those of a conventional glove, being also substantially wider than the fingers (6, 7 respectively) that they are designed to accommodate and extending in length only to around the position of the second joint (referenced to the finger tip) of each of the respective fingers.

This creates wide, short finger compartments, making the gloves easier to don and remove than would be the case with gloves having finger compartments matching more closely the fingers they are designed to accommodate. The latter kind of glove also places greater restriction on the mobility of the wearer's hands, compromising dexterity, and can also place increased stress on the film, causing splits and tears, especially at the seams.

A further advantage of the construction shown is that "webs" such as that shown in 8 are created between adjacent fingers, and this increases the capacity for handling without dropping or spillage foodstuffs (such as burgers) or frangible or malleable materials in general.

Importantly, the thumb compartment 9 of the glove is capable of accommodating the entire length of the thumb 10 which is intended to be inserted therein. Indeed, the compartment 9 is also wider than the thumb compartment of a conventional glove, for the reasons of ease and rapidity of donning and removal as mentioned above in relative to the finger compartments, and also to provide the wearer with an improved reach between forefinger 6 and thumb 10.

The palm width is greater than that of a conventional glove to accommodate the wider finger and thumb compartments and to give greater comfort to the wearer. The glove opening is also wide, for the same reasons and also because it permits easy donning and removal of the glove.

The generosity of the various width dimensions referred to above also assists in the event that the wearer desires or needs to wear an underglove. This may happen, for example, where an operative is removing hot burgers from a griddle and placing them at a finished food preparation station, or an intermediate station, and thus needs to wear thermally protective gloves (such as terryknit or kevlar gloves) beneath the disposable plastic gloves of the invention. The gloves in accordance with the invention will not only dimensionally accommodate the undergloves, but will protect them from soiling by the material being handled, and will also permit wearers to retain mobility and dexterity in their fingers and hands.

The nylon material is able to withstand at least brief contact with hot cooking surfaces or hot food without degrading with adherence to either. Importantly. The material will not leave plastics residues on food. The heat sealing of the juxtaposed films ensures that the glove seams are welded, making the gloves liquid proof and chemically resistant. They can thus be used in engineering as a barrier to oils and greases.

Although heat sealing techniques have been described thus far for the sealing together of the juxtaposed films of plastics material, other sealing techniques such as ultrasonic welding can be used instead or additionally if desired.

The following specific dimensions relate to a particular size of glove in accordance with an example of the invention:

| | |
|---|---|
| Length of little finger | 47 mm |
| Length of second finger | 60 mm |
| Length of middle finger | 67 mm |
| Length of forefinger | 58 mm |
| Length of thumb | 73 mm |
| Width of little finger | 56 mm |
| Width of second finger | 59 mm |
| Width of middle finger | 56 mm |
| Wldth of forefinger | 55 mm |
| Width of thumb | |
| Total length | 300 mm |
| Palm width | 160 mm |
| Width at opening of glove | 155 mm |

The foregoing values relate to an example of a large sized, 300 mm long glove, and may clearly be adapted for other glove sizes.

In general, the width of each finger compartment should be the range of 1.6 to 2.6 times wider than the finger it is to accommodate, with the preferred width being approximately in the centre of that range, i.e. about 2.1 times the finger width. The length of each finger compartment should preferably be such as to accommodate the respective finger as far as the second joint (from its tip) but may alternatively be dimensioned to accommodate the finger merely as far as its first joint, or to any point between the two joints, and the relationship is not necessarily the same for all finger compartments. Depending upon the application, there can be advantage in having larger "webs", albeit with reduced finger mobility, at the outside or inside of the hand.

The invention can also be applied to gloves such as gauntlets which reach farther along the wearer's arms than do conventional gloves, and can thus protect sleeve and cuff portions if desired.

It will further be understood that the sample illustrated shows an application of the invention for the purposes of illustration. In practice, the invention may be applied to many different configurations, all straightforward for those skilled in the art to implement in the light of the foregoing.

What is claimed is:

1. A disposable glove, comprising first and second juxtaposed shaped films of plastics material, said films being sealed together around their peripheries (2) except in a region (3) thereof forming an opening dimensioned and located to accommodate insertion and withdrawal of a user's hand; characterised in that the glove (1) comprises respective compartments (4,5) each positioned and dimensional to accommodate only part of the length of a respective finger (6,7) of the user, the plastics material forming webs (8) between adjacent fingers (6,7).

2. A glove according to claim 1, characterised in that the length of each finger compartment (4,5) extends beyond the first joint, but not beyond the second joint (referenced to the fingertip) of the user's finger (6,7).

3. A glove according to claim 1, wherein the width dimension of each compartment (4,5) is substantially larger than necessary to accommodate the user's finger.

4. A glove according to claim 3, characterised in that said width dimension is in the range 1.6 to 2.6 times larger than the width of the user's finger.

5. A glove according to claim 4, characterised in that said width dimension is approximately 2.1 times larger than the width of the user's finger.

6. A glove according to claim 1 the glove (1) comprises a thumb compartment (9) dimensioned to accommodate substantially the entire length of the thumb (10) of the user.

7. A glove according to claim 1 which, when measured across its palm area and across the opening (3) dimensioned and located to accommodate insertion and withdrawal of the user's hand, is substantially wider than necessary to accommodate the user's hand and wrist.

8. A glove according to claim 1 wherein the plastics material comprises a heat resistant plastics material having a melting point of 200 degrees C. or greater.

9. A glove according to claim 8 characterised in that the heat resistant plastics material is a polyamide film.

10. A glove according to claim 9 characterised in that said polyamide material comprises one of Nylon 6 and Nylon 66.

11. A glove comprising first and second juxtaposed shaped films of plastics material defining a generally sealed pouch for accommodating a user's hand, characterised by the pouch having a plurality of compartments (4,5) defined therein; each of said compartments (4,5) being positioned and dimensioned to accommodate only an upper part of a respective finger (6,7) of the user's hand.

* * * * *